United States Patent [19]

Legault

[11] Patent Number: 4,874,390

[45] Date of Patent: Oct. 17, 1989

[54] METHOD AND APPARATUS FOR TINTING YARN

[75] Inventor: Clayton M. Legault, Kingston, Canada

[73] Assignee: Du Pont Canada Inc., Mississauga, Canada

[21] Appl. No.: 251,962

[22] Filed: Sep. 29, 1988

[51] Int. Cl.[4] ..... D06B 1/02

[52] U.S. Cl. ..... 8/149.1; 8/151.2; 8/403; 8/477; 68/5 D; 68/205 R

[58] Field of Search ..... 8/149.1, 151.2, 403, 8/477, 499; 68/5 D, 5 E, 205 R; 28/178, 184

[56] References Cited

U.S. PATENT DOCUMENTS

| | | | |
|---|---|---|---|
| 2,351,729 | 6/1944 | Whitehead et al. | 68/13 R X |
| 3,899,903 | 8/1975 | Lapierre | 68/205 R |
| 4,100,724 | 7/1978 | Bous | 68/205 R X |
| 4,153,961 | 5/1979 | Cleveland | 68/205 R X |
| 4,485,508 | 12/1984 | Otting | 8/477 X |
| 4,569,107 | 2/1986 | Pomeroy | 8/151.2 X |
| 4,662,194 | 5/1987 | Stanley | 68/205 R |

FOREIGN PATENT DOCUMENTS

| | | | |
|---|---|---|---|
| 4574 | 2/1973 | Japan | 8/499 |
| 298837 | 8/1954 | Switzerland | 68/205 R |

OTHER PUBLICATIONS

"Model 100 Doghouse Fugitive Tint Applicator", Brochure Supplied by Air & Hydraulic Equipment, Inc., Chattanooga, TN.

*Primary Examiner*—Philip R. Coe

[57] ABSTRACT

An apparatus for producing heat set, tinted yarn. The apparatus comprises yarn heat setting means and yarn tinting means for tinting said yarn after heat setting in the yarn heat setting means. The yarn tinting means comprises a tinting chamber having openings therein to allow for passage of yarn therethrough, yarn guide means for guiding the yarn through the tinting chamber, spray nozzles locatable within the chamber for spraying tint onto the yarn within the chamber and means for exhausting excess tint from the chamber.

14 Claims, 4 Drawing Sheets

METHOD AND APPARATUS FOR TINTING YARN

BACKGROUND OF THE INVENTION

This invention relates to a method and apparatus for tinting yarn and, more particularly, to a method and apparatus for applying a fugitive tint to a yarn to identify the yarn.

Generally, an end user, such as a carpet manufacturer, may receive from a yarn producer different types of yarn, having different dyeabilities, tenacities or other properties. Conventionally, the type of yarn is indicated on each package of yarn received from the yarn producer, but when the yarn is removed from the package, it is often impossible for the end user to distinguish it from other types of yarn. This is especially a problem in such processes as twisting, tufting, and mending where several packages of yarn may be used.

Fugitive tints, such as water-soluble dyes have been applied to yarns to enable the type of yarn to be identified by end users. Versatint* N-6 dye (Milliken Laboratories - USA) is normally used on nylon staple while Versatint II dye is recommended for BCF nylon yarns. Other commercially available fugative tints include Megatint* dye (Chemurgy Products Inc). Such tints are removable from the yarn prior to the final processing steps so that product quality is not adversely affected. Attempts have been made to apply such tint to yarn by spraying it onto yarn packages. This has the disadvantage of being messy and environmentally hazardous due to the presence of excess air-borne tint. Moreover, the visibility of the tint along the threadline is low once the yarn is removed from the package and after such operations as twisting, the tint is even more difficult to see.

* denotes Trademark

STATEMENT OF THE INVENTION

It is an object of the present invention to obviate or mitigate the above-mentioned disadvantages.

Accordingly, the invention provides an apparatus for producing heat-set, tinted yarn comprising:

yarn heat setting means; and yarn tinting means for tinting said yarn after heat setting in said yarn heat setting means, said yarn tinting means comprising a tinting chamber having openings therein to allow for passage of yarn therethrough, yarn guide means for guiding said yarn through said tinting chamber, spray nozzles locatable within said chamber for spraying tint onto said yarn within said chamber and means for exhausting excess tint from said chamber.

In another one of its aspects, the invention provides an apparatus for tinting yarn, said yarn tinting apparatus comprising a tinting chamber having openings therein to allow for passage of yarn therethrough, yarn guide means for guiding said yarn through said tinting chamber, spray nozzles locatable within said chamber for spraying tint onto said yarn within said chamber and means for exhausting excess tint from said chamber.

In a further one of its aspects, the invention provides a process for tinting yarn comprising passing yarn through an at least partially enclosed spraying zone, spraying yarn with tint in said spraying zone, and simultaneously removing excess tint from said spraying zone.

DESCRIPTION OF THE PREFERRED EMBODIMENTS

In the present invention, the yarn is sprayed continuously in an at least partially enclosed chamber and excess tint is continuously removed from the system to reduce the amount of undesirable deposits of excess tint and to reduce the health hazard created by air-borne excess tint.

The process of the present invention may be carried out by the yarn producer in the yarn production line or by the end user. Preferably, the yarn is heat-treated prior to tinting, since heat-treating after tinting may cause the tint to be permanently fixed to the yarn. Heat-treatment may be performed in a batchwise manner in an autoclave or may be performed continuously in a commercially available continuous heat treating apparatus. These continous apparatuses generally comprise an enclosed steam heating zone in which the heat treating takes place followed by a cooling zone which is open to ambient conditions and which is sufficiently long to allow the yarn to cool prior to being wound onto a package. For space saving reasons, the cooling zone is often located above the heating zone. A pair of guides may be used, one to guide the yarn from the exit of the heating zone to the region above the heating zone and one to guide the yarn to a winding apparatus. Ideally, the tinting apparatus is located in the cooling zone of the heat treating apparauts, since the guides of this zone can be adjusted to guide the yarn into the tint applicator. Also, the yarn in this zone is usually at an ideal temperature for tinting because it is sufficiently cool that the tint will not be permanently bonded to the yarn, but is still warm enough to enhance coverage of the yarn with tint.

The tint applicator of the invention preferably employs compressed air to siphon tint from a tint reservoir and to atomize the tint through at least one spray nozzle. Compressed air is generally readily available from the heat treating apparatus since these apparatuses tend to rely on compressed air to operate their heating zones at elevated temperatures.

To ensure that excess tint is removed from the system and returned to a tint reservoir, the tint applicator preferably employs deflectors to deflect excess tint away from the openings in the tint chamber and a suction generating apparatus such as a vortex generator in a drain in the base thereof. Compressed air is preferably employed to generate the vortex.

Preferred embodiments of the invention will be further described, by way of illustration only, with reference to the following drawings, in which.

Figure 1:
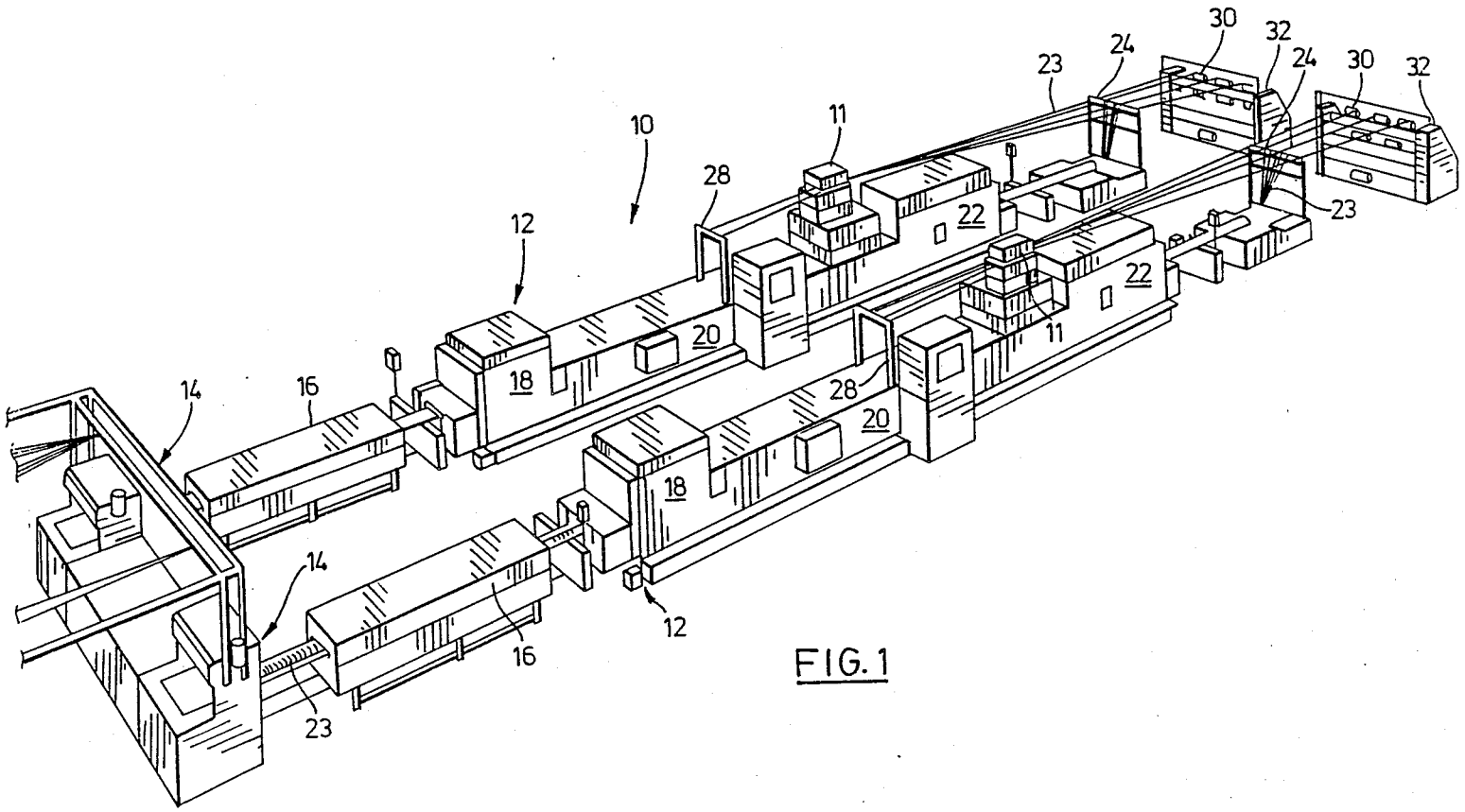
FIG. 1 is a perspective view of a heat-setting apparatus with a tint applicator mounted thereon.

Referring to FIG. 1, a heat setting apparatus 10 having a tint applicator 11 mounted thereon is shown. This apparatus 10 has two identical lines 12, each of which includes a coiling apparatus 14, followed by a prebulker 16 connected to a first cooling chimney 18. In line with this first cooling chimney 18 is a heat setting tunnel 20 followed by a second cooling chimney 22. Yarn 23 is passed through these apparatuses and then is guided by a first guide 24 over the top of the heat setting apparatus 10 to the tint applicator 11 mounted on top of the heat setting tunnel 20. The yarn 23 passes through this applicator 11 to a second guide 28 which reverses the yarn and guides it back into the tint applicator 11 for a second time. The yarn then passes over the first guide 24 and is wound onto packages 30 in a winding apparatus 32.

Figure 2:
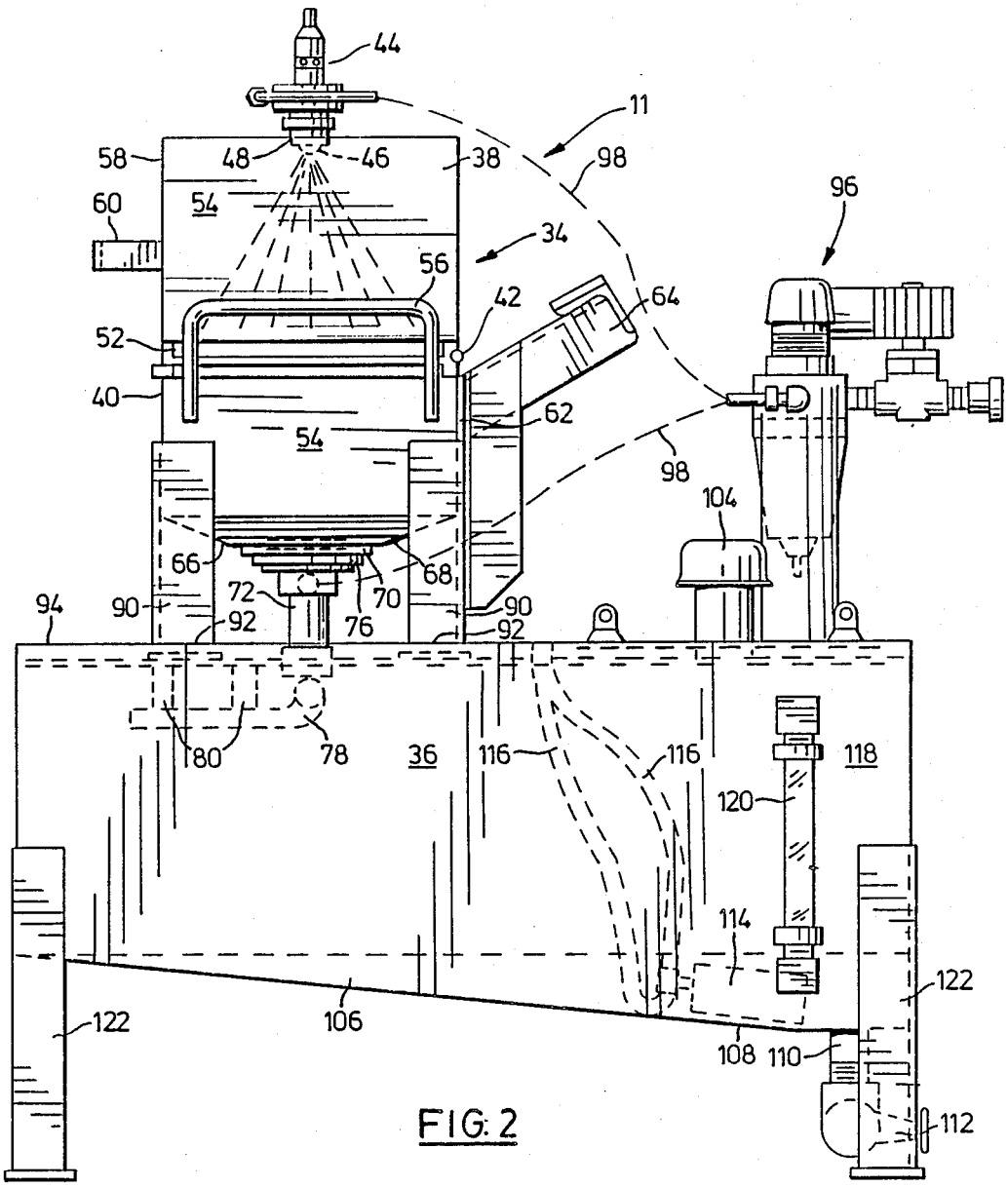
FIG. 2 is side view of the tint applicator of FIG. 1.
Figure 3:
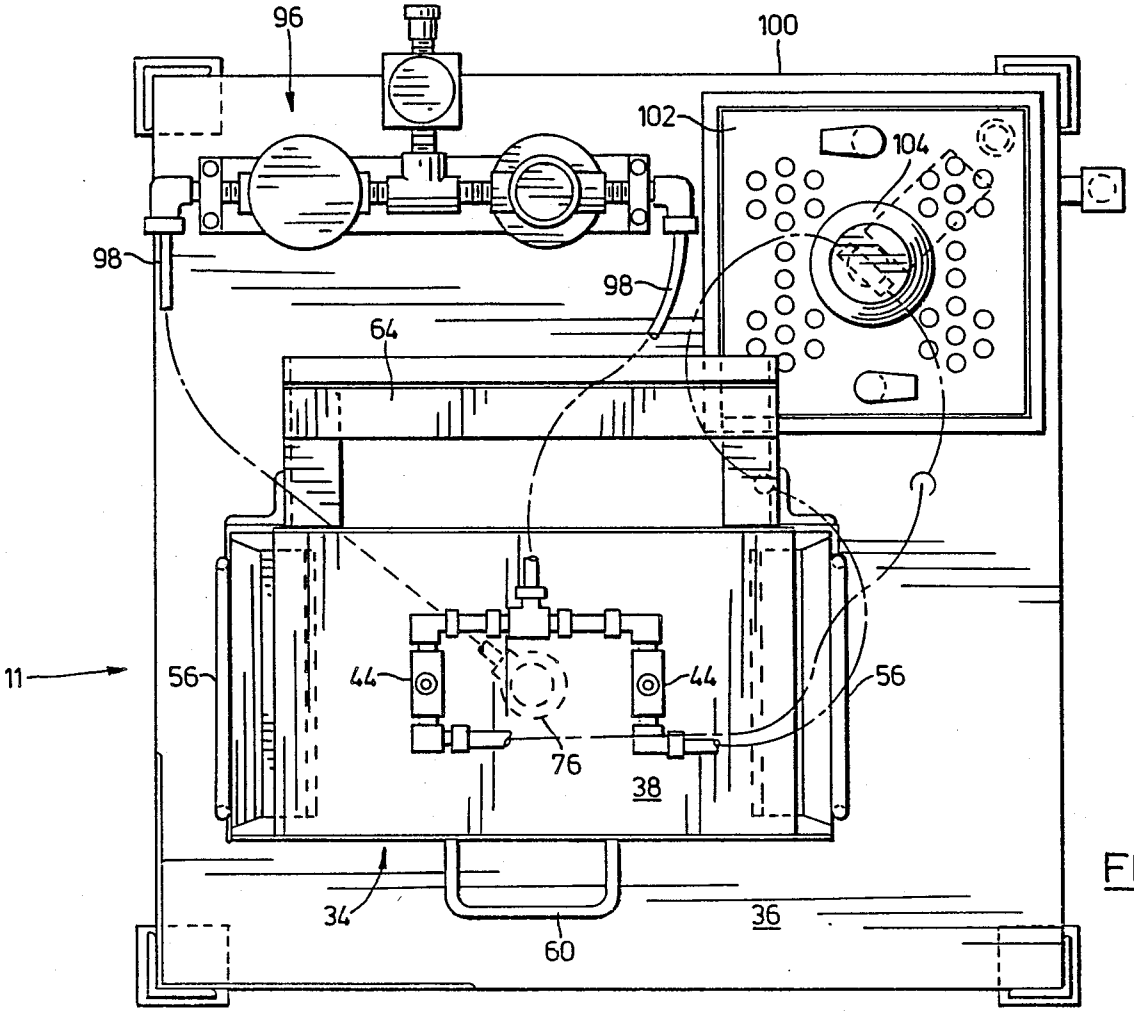
FIG. 3 is a top view of the tint applicator of FIG. 1.

Details of the tint applicator 11 can be seen in FIGS. 2 and 3. The tint applicator 11 comprises a tinting chamber 34 mounted on top of a tint reservoir 36. The tinting chamber 34 is defined by an upper enclosure 38 and a lower enclosure 40 connected together by a leak resistant hinge 42. A pair of spray jets 44 are located on top of the upper enclosure 38 with their nozzles 46 extending into the chamber 34 through holes 48 in roof 50 of the upper enclosure 38. The nozzles 46 are adapted to each spray a fine jet of tint perpendicular to yarn passing through the chamber.

An opening 52 is provided between each of the side walls 54 of the upper enclosure 38 and the lower enclosure 40 to allow yarn to pass through the chamber 34. Guides 56 are attached to the lower enclosure 40 on each of the side walls 54 to guide yarn into the openings 52.

The front wall 58 of the upper enclosure 38 is provided with a handle 60 and the rear wall 62 of the lower enclosure 40 is provided with a bumper 64 to allow the upper enclosure 38 to be rotated relative to the lower enclosure 40 until it rests on the bumber 64 to provide access to the chamber 34.

The bottom 66 of the lower enclosure 40 is provided with sloping walls 68 leading downwardly to a drain opening 70. A fine mesh screen covers this opening to trap loose fibres, lint undesirables and particles. A drain 72 extends from this opening 70 to the roof 94 of the reservoir 36. A vortex generator 76 is located in this drain to generate a vortex to ensure removal of vapourized excess tint from the chamber. Extending perpendicularly from the drain 72 into the reservoir is flexible liquid tubing 78 attached to the roof 94 of the reservoir by clamps 80.

Figure 4:
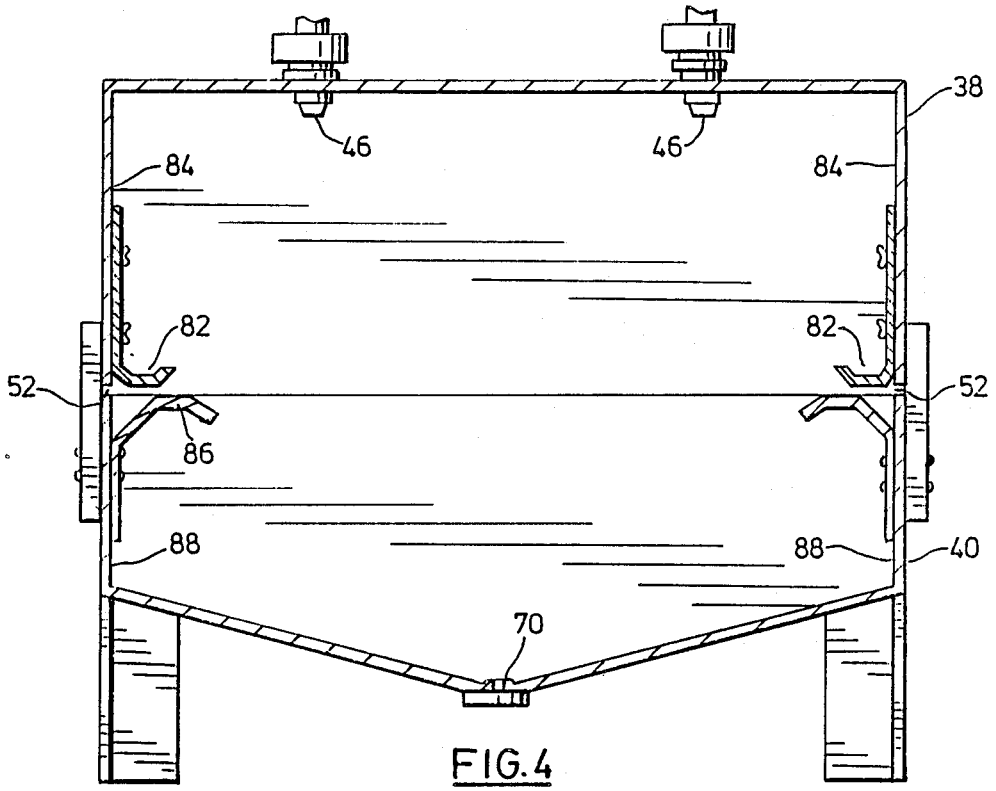
FIG. 4 is a cross sectional view of the chamber of the tint applicator of FIG. 1.

Details of the interior or the upper and lower enclosures can be seen in FIG. 4. Baffles 82 are mounted on the inner side walls 84 of the upper enclosure 38 above each of the openings 52 to deflect spray from the nozzles 46 away from the openings 52. Similarly, baffles 86 are mounted on the inner side walls 88 of the lower enclosure 40 below each of the openings 52 to deflect spray away from the openings and towards the drain opening 70.

Referring back to FIGS. 2 and 3, it can be seen that the lower enclosure 40 is supported by four legs 90, one at each corner thereof. These legs 90 are welded in place and are welded at their bases 92 to the roof 94 of the reservoir 36. Also located on the roof of the reservoir is a solenoid valve 96 connected to an compressed air supply (not shown). This valve 96 operates on 110 V and directs air on command to pressure regulators associated therewith and are connected by two pieces of PVC air tubing 98 (partially indicated by ghost outline) to the jets 44 and the vortex generator 76 respectively. As can be most clearly seen in FIG. 3, adjacent to the valve 96 is an opening 100 in the roof 94 of the reservoir, which is covered by a cover plate 102. A breather cap 104 is located in this plate 102 to release pressure created in the reservoir by the vortex generator 76. The underside of this plate is provided with a filter material layer (not shown) to impede the escape of tint mist from the reservoir. The base 106 of the reservoir slopes towards the corner 108 of the reservoir that is beneath this plate 102. A drain 110 is located in this corner having a valve 112 therein. Also located in this corner 108 is a filter 114 (shown in dotted outline) which is connected to two pieces of PVC liquid tubing 116 leading to respective ones of the spray jets 44. This filter 114 is intended to trap lint that might be resident in the reservoir. On an outer wall 118 of the reservoir adjacent to this corner is mounted a sight glass 120 to allow detection of the level of tint in the reservoir.

The reservoir is supported by four legs 122, one at each corner thereof. These legs rest on the top of the heat setting tunnel 20 at a suitable location before the second cooling chimney 22 as illustrated in FIG. 1.

In operation, yarn is passed through the openings 52 in the side walls 54. Tint is withdrawn from the reservoir and is pneumatically sprayed onto the yarn by the jets 44. The baffle plates 82, 86 deflect tint spray away from the openings 52. The vortex generator 76 draws excess tint mist out of the chamber and directs it back into the reservoir 36.

In a particularly preferred unit, the heat setting machine 10 used is the Superba heat setting unit (type TVP). The spray jets are preferably Spraying Systems Co. spray jets with flat spray air atomizing nozzles of the 1/4J Series. The vortex generator is preferably a Vortec Transvector Model No: 952. The solenoid valve is preferably an electrically operated Dema general purpose solenoid valve Model A413P, 110 V., ⅜" NPT (available from John Brooks, Canada Ltd.).

It is to be appreciated that modifications may be made to the preferred embodiments of the invention. For instance, the tint reservoir 36 may be located above the chamber 34 and the tint introduced into the spray jets 44 by gravity rather than by a siphon action. Also, other means can be used to exhaust excess tint from the reservoir instead of a vortex generator, such as a vacuum pump.

I claim:

1. An apparatus for producing heat set, tinted yarn comprising:

yarn heat setting means;

yarn tinting means for tinting said yarn after heat setting in said yarn heat setting means, said yarn tinting means comprising a tinting chamber having openings therein to allow for passage of yarn therethrough, yarn guide means for guiding said yarn through said tinting chamber, spray nozzles locatable within said chamber for spraying a fine atomized spray of tint onto said yarn within said chamber, said nozzles each having a compressed air inlet and a tint inlet, and means for exhausting excess tint from said chamber; and a tint reservoir located beneath said yarn tinting means, said tint reservoir being connected to the tint inlets of the nozzles whereby compressed air entering said air inlets siphons tint from said reservoir to transport it to said nozzles.

2. The apparatus of claim 1 wherein a yarn cooling zone is provided for cooling said yarn after said yarn has been passed through said heat setting means, said yarn tinting means being located within said yarn cooling zone.

3. The apparatus of claim 2 wherein said yarn cooling zone includes cooling zone guide means includes a first guide for directing yarn exiting from said heat setting means through said chamber and a second guide for turning said yarn upsidedown and redirecting yarn exiting from said chamber back into said chamber.

4. The apparatus of claim 1 wherein said chamber has a drain in the bottom thereof, and wherein said means for exhausting excess tint comprises a vortex generator located in said drain, said vortex genertor being connectable to said compressed air source.

5. The apparatus of claim 4 wherein said drain is connected to said reservoir and wherein said reservoir includes a vent to exhaust pressurized air therefrom.

6. The apparatus of claim 1 wherein said chamber has baffles located adjacent to the openings thereof to deflect tint away from said openings.

7. The apparatus of claim 1 wherein said chamber comprises a lower portion and an upper portion, and wherein the lower portion is connected to the upper portion by a hinge.

8. Apparatus for tinting yarn, said apparatus comprising a tinting chamber having openings therein to allow for passage of yarn therethrough, yarn guide means for guiding said yarn through said tinting chamber, spray nozzles locatable within said chamber for spraying a fine atomized spray of tint onto said yarn within said chamber, said nozzles each having a compressed air inlet and a tint inlet, and means for exhausting excess tint from said chamber; and a tint reservoir located beneath said tinting chamber, said tint reservoir being connected to the tint inlets of the nozzles whereby compressed air entering said air inlet siphons tint from said reservoir to transport it to said nozzles.

9. The apparatus of claim 8 wherein said chamber has a drain in the bottom thereof, and wherein said means to exhaust excess tint comprises a vortex generator located in said drain, said vortex generator being connectable to said compressed air source.

10. The apparatus of claim 9 wherein said drain is connected to said reservoir and wherein said reservoir includes vent means to exhaust pressurized air therefrom.

11. The apparatus of claim 8 wherein said chamber has baffles located adjacent to the openings thereof to deflect tint away from said openings.

12. The apparatus of claim 8 wherein said chamber comprises a lower portion and an upper portion, and wherein the lower portion is connected to the upper portion by a hinge.

13. A process for tinting yarn comprising passing yarn through an at least partially enclosed spraying zone, spraying yarn with tint in said spraying zone, and simultaneously removing excess tint from said spraying zone, wherein said step of removing excess tint comprises providing a draining zone connected to said spraying zone and to a tint storage zone, creating suction in said draining zone to draw excess tint from said spraying zone through said draining zone to said reservoir and deflecting excess tint in said spraying zone toward said draining zone, and wherein the tint storage zone is located below the spraying zone and wherein tint is transported to said spraying zone by siphoning.

14. The process of claim 13 wherein said yarn is heat treated prior to entering said spraying zone.

* * * * *